US005741463A

United States Patent [19]

Sanadi

[11] Patent Number: 5,741,463

[45] Date of Patent: Apr. 21, 1998

[54] APPARATUS FOR PREVENTING CROSS-CONTAMINATION OF MULTI-WELL TEST PLATES

[76] Inventor: Ashok Ramesh Sanadi, 2704 Arlington Blvd., Apt. 2, Arlington, Va. 22204

[21] Appl. No.: 530,967

[22] Filed: Sep. 20, 1995

Related U.S. Application Data

[63] Continuation of Ser. No. 195,125, Apr. 4, 1994, abandoned, which is a continuation-in-part of Ser. No. 49,171, Apr. 19, 1993, Pat. No. 5,342,581.

[51] Int. Cl.[6] ..... B01L 11/00

[52] U.S. Cl. ..... 422/101; 422/102; 436/177; 436/178; 435/301; 435/311

[58] Field of Search ..... 422/58, 69, 101, 422/102, 104; 436/165, 177, 178, 809; 435/301, 311

[56] References Cited

U.S. PATENT DOCUMENTS

| | | | |
|---|---|---|---|
| 3,206,017 | 9/1965 | Williams | 206/56 |
| 3,302,854 | 2/1967 | Midgley et al. | 229/43 |
| 3,366,265 | 1/1968 | Hesselbarth | 220/23.4 |
| 4,246,339 | 1/1981 | Cole et al. | 435/7 |
| 4,392,389 | 7/1983 | Eckstein et al. | 73/864.91 |
| 4,493,815 | 1/1985 | Fernwood et al. | 422/101 |
| 4,626,509 | 12/1986 | Lyman | 435/287 |
| 4,704,255 | 11/1987 | Jolley | 422/101 |
| 4,777,021 | 10/1988 | Wertz et al. | 422/101 |
| 4,895,706 | 1/1990 | Root et al. | 422/102 |
| 4,902,481 | 2/1990 | Clark et al. | 422/101 |
| 4,927,604 | 5/1990 | Mathus et al. | 422/101 |
| 4,948,442 | 8/1990 | Manns | 156/73.1 |
| 4,948,564 | 8/1990 | Root et al. | 422/101 |
| 5,011,779 | 4/1991 | Maimon | 435/293 |
| 5,038,852 | 8/1991 | Johnson et al. | 165/12 |
| 5,047,215 | 9/1991 | Manns | 422/101 |
| 5,056,427 | 10/1991 | Sakabe et al. | 100/211 |
| 5,076,933 | 12/1991 | Glenn et al. | 210/641 |
| 5,104,533 | 4/1992 | Szabados | 210/257.1 |
| 5,108,704 | 4/1992 | Bowers et al. | 422/70 |
| 5,110,556 | 5/1992 | Lyman et al. | 422/101 |
| 5,112,574 | 5/1992 | Horton | 422/102 |
| 5,130,105 | 7/1992 | Carter et al. | 422/245 |
| 5,133,939 | 7/1992 | Mahe | 422/104 |
| 5,141,719 | 8/1992 | Fernwood et al. | 422/101 |
| 5,178,779 | 1/1993 | Gironda et al. | 210/800 |
| 5,219,528 | 6/1993 | Clark | 422/101 |
| 5,282,543 | 2/1994 | Picozza et al. | 220/255 |

FOREIGN PATENT DOCUMENTS

| | | | |
|---|---|---|---|
| 0311440A2 | 10/1988 | European Pat. Off. | G01N 35/06 |
| 0388159A2 | 3/1990 | European Pat. Off. | B01L 3/00 |

OTHER PUBLICATIONS

Brochure of the BEADPREP 96, Magnetic Separator/Concentrator.

Millititer Filtration System, Bio/Analytical Test Products.

96, 192, and 384 Well Plates for Every Occasion, USA Scientific Plastics, Inc., 1993.

*Primary Examiner*—Harold Y. Pyon

*Attorney, Agent, or Firm*—Dykema Gossett PLLC

[57] ABSTRACT

A multi-well plate which prevents cross-contamination of samples through the use of a resilient gasket which covers a majority of the top of the plate and is compressed by a lid having a clamp assembly. It thus provides a sealing assembly for arrays of containers of any size or shape. The gaskets may be unitary sheets with or without an array of openings corresponding to the well openings or may consist of discrete single well gaskets. A multi-tube array is also provided which can be sealed without the need of a gasket or tight-fitting caps. A multi-well plate is also disclosed in which samples can be gas-equilibrated without the risk of microbial contamination.

4 Claims, 4 Drawing Sheets

Fig-2
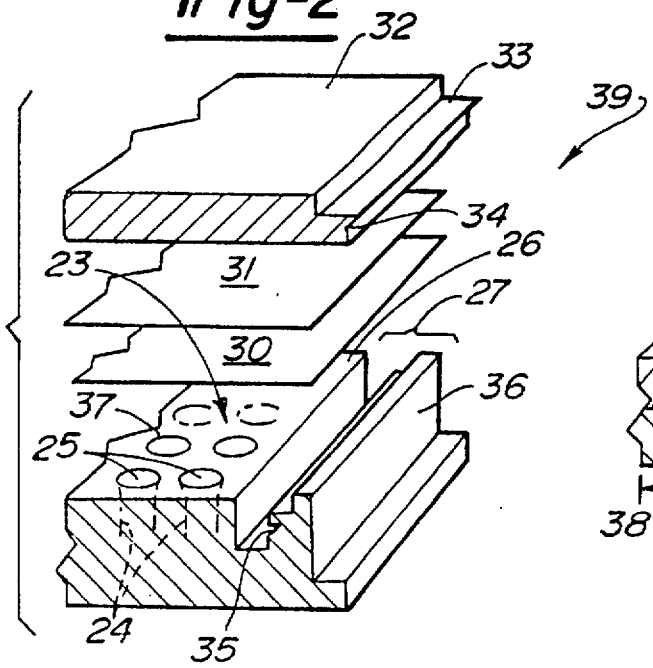
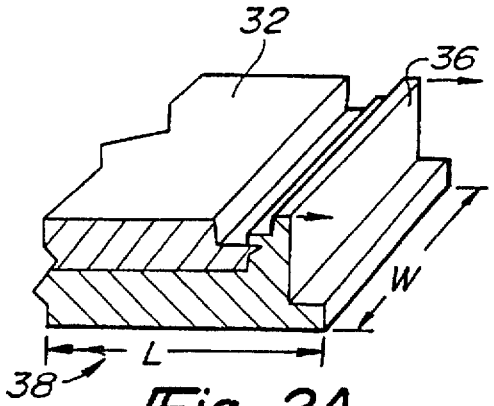
Fig-2A
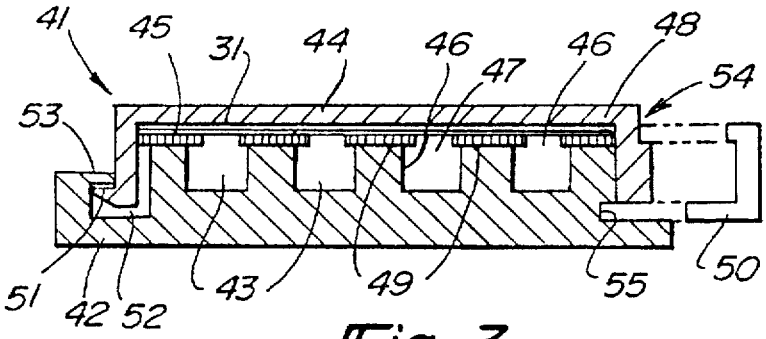
Fig-3
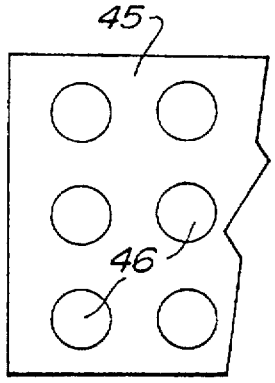
Fig-3B
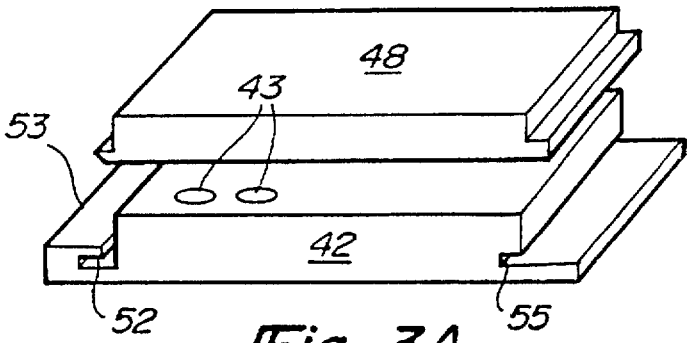
Fig-3A
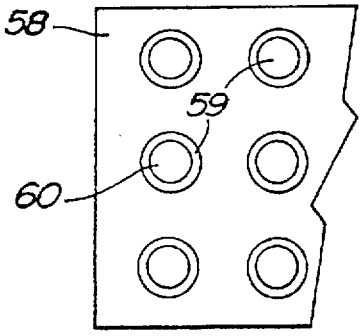
Fig-3C

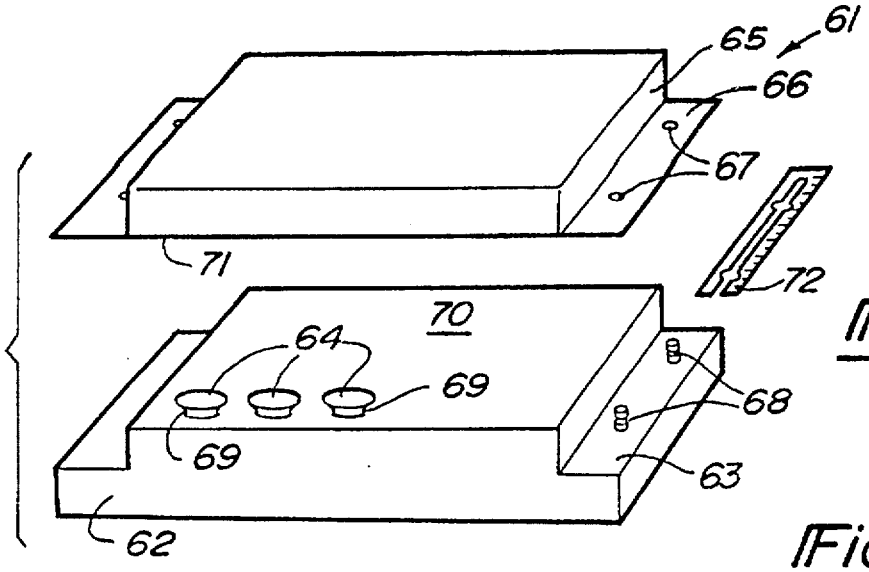
Fig-4
Fig-4B
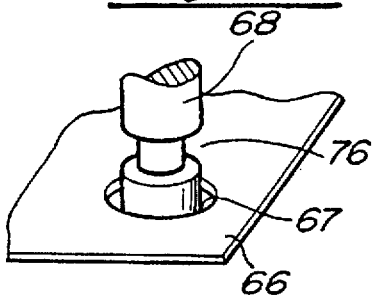
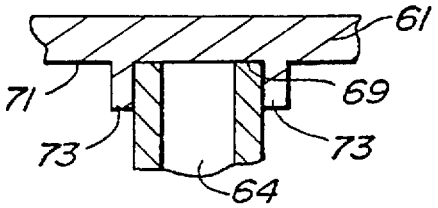
Fig-4A
Fig-5A
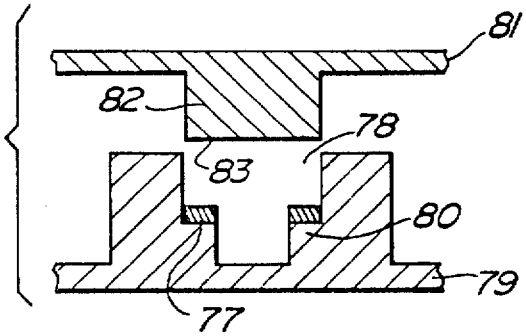
Fig-5
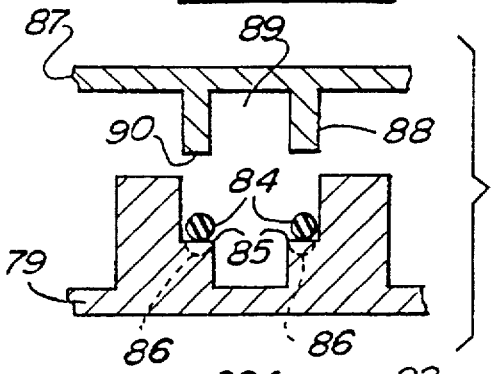
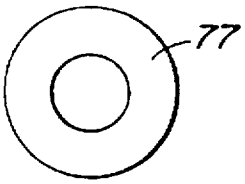
Fig-5B
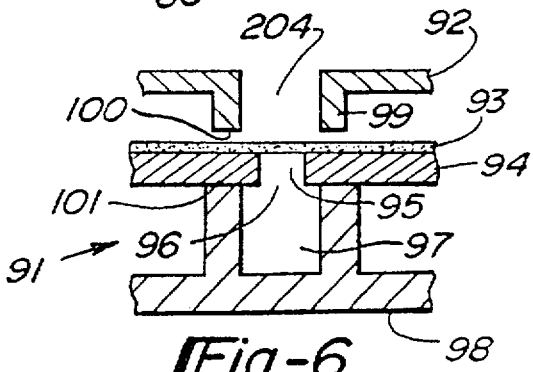
Fig-6

APPARATUS FOR PREVENTING CROSS-CONTAMINATION OF MULTI-WELL TEST PLATES

TECHNICAL FIELD OF THE INVENTION

This application is a continuation of application Ser. No. 08/195,125 filed on Apr.4, 1994 which is abandoned, which is a Continuation-In-Part of application Ser. No. 08/049,171 filed on Apr. 19, 1993, now U.S. Pat. No. 5,342,581, entitled "Method and Apparatus For Preventing Gross-Contamination of Multi-Well Test Plates" the entire disclosure of which is incorporated herein by reference.

This invention relates generally to multi-well plates and tube arrays in which samples (biological, chemical, etc.) are analyzed or processed. More specifically, the present invention solves the problem associated with cross-contamination of samples which may occur in the use of a closely spaced array of wells or tubes. The present invention also relates to a multi-well plate which can be used for analysis or processing in a controlled atmosphere without the possibility of contamination from atmospheric sources. In addition, the present invention describes a new type of multi-well plate which can be clamped together.

BACKGROUND OF THE INVENTION

A number of laboratory and clinical procedures require the use of an array of wells or tubes in which multiple samples are placed for analysis, cell growth, amplification, isolation or other purposes. In general, conventional multi-well plates and tube arrays (non-filtration type) have a single opening at the top through which samples are added or removed.

An important disadvantage in the use of arrays of tubes mounted within a plate, and with multi-well plates (either with or without a filtration feature) is the problem associated with contamination of the samples. Most laboratory protocols must be performed with a high degree of stringency in terms of limiting contamination of the samples. When multiple samples are processed in a confined area, such as an 8×12 or 4×6 format, strip wells (in strips of 8 or 12 wells), or in any format with multiple sample containers in a small area, the risk of cross-contamination of samples is significant, giving rise to erroneous results. If a single unitary plate (as currently available) is used as a collective lid to cover the tops of all the wells or tubes, the lack of a seal could allow the migration of samples between wells or tubes during handling, or simply through condensation and capillary processes. Tapes which are used currently to seal the tops of the wells are not very reliable. Adhesive tapes limit the number of conditions that the plate can be subjected to (efficient boiling, freeze-thawing and vortexing the plate are difficult without causing cross-contamination) and heat sealing tape requires specialized heat-sealing equipment. Incorporation of a tape sealing process in automated systems would be difficult. In addition, multi-well or tube arrays which utilize individual stoppers are unwieldy and allow the introduction of contaminants as the reagents and the like are added to the wells/tubes. This problem of cross-contamination is particularly acute when tight fitting caps and tape are opened, which frequently results in aerosol formation. These aerosols, in addition to being a potential source of cross-contamination, may also be hazardous to the operator.

A problem often encountered with cell culture procedures is the contamination of the cultures by microorganisms from the environment or the atmosphere. This problem has been difficult to overcome, because cell-culture procedures often require the microorganisms to be grown in a controlled atmosphere (such as 5% carbon dioxide); the conventional plates therefore have a loose fitting lid to reduce evaporation while allowing gas exchange and yet minimizing contamination. Also, it would not be possible to clamp the lid to the multi-well plate without changing the dimensions of the plate, which would make it difficult to use with existing instruments such as plate readers, centrifuges and the like. It is important to appreciate that the use of the membrane in the present invention is very different from prior art involving 96-well filtration devices, where the liquid samples have to come in contact with the membrane for the purpose of filtration. Thus, in the prior art, the membrane provides for flow-through of liquid, with the liquid often in contact with the membrane for prolonged periods of time prior to filtration. In the present invention the membrane prevents flow-through of non-gaseous materials, but allows gas-exchange.

Conventional glass microscope slides having one or more wells are now being used as sample holders for in situ nucleic acid amplification techniques such as PCR. Generally, either glue or cosmetic nail enamel is used to stick the cover directly to the slide, requiring the use of heat or a solvent to remove the cover.

Therefore, it is an object of the present invention to provide a plate/tray assembly having an array of sample containment sites which are designed to reduce the risk of cross-contamination between containment sites.

It is another object of the present invention to provide a multi-well plate or tube array in which cross-contamination of samples is significantly reduced by providing a resilient gasket which isolates each containment site.

It is yet another object of the present invention to have a tube array (or multi-well plate) which can be sealed without the use of a gasket or tight fit caps.

It is a further object of the present invention to provide a method of leaving samples in the sample containment sites in the multi-well plate/tube array open to the atmosphere and yet sealed from microbial, particulate or other contamination from atmospheric sources.

It is still a further object of the present invention to provide a sample containment assembly of multiple samples (such as 96 well plates and cluster plates) which can be hermetically sealed and clamped together without changing the effective dimensions of the assembly so that standardized equipment such as automated well washers, automated scanning instruments and centrifuges can still be used.

Finally, it is still a further object of the present invention to provide a sealing system for glass or plastic slides, which can be used without gluing the cover slip to the slide.

SUMMARY OF THE INVENTION

In one aspect, the present invention provides an apparatus for handling multiple samples having a plurality of containment sites such as wells or tube-like vessels defining wells. The wells or tubes may be discrete elements temporarily attached to a tray or plate or preferably are formed integrally with a plate. Each well has one closed end and one open end. The plate (and thus the closed end) may be formed of a number of fluid impervious materials such as a rigid plastic. The apparatus further includes a lid which covers the principal or top surface of the plate or tray such that the lid simultaneously covers all of the openings of the containment sites or wells. Between the lid and the principal surface of the tray or plate, a layer of resilient material such as a synthetic rubber membrane is provided which serves as a gasket. In one embodiment the gasket is a single unitary sheet which covers all of the openings of the containment sites of the plate or tray. Thus, the gasket serves as a closure for each specimen chamber. The lid is then clamped or otherwise secured to the plate or tray with sufficient force to compress the gasket and provide sealing contact between the gasket and the tray or plate to seal the well openings. The apparatus can then be placed in various orientations without movement or loss of the samples from their respective containment sites.

In another aspect, the gasket feature of the present invention comprises a plurality of discrete gaskets or gasket sections each of which covers one or several openings of the plate. The discrete gaskets extend beyond each individual opening a sufficient distance to provide a seal between the individual containment sites.

In still another aspect, the gasket of the present invention is further provided with openings in register or alignment with each of the openings of the containment sites of the plate or tray such that access to the individual containment sites may be achieved by simply removing the lid.

In another embodiment, a mylar sheet or membrane is disposed on top of the gasket in that embodiment in which the gasket has a plurality of openings.

In yet another embodiment, a new format of multi-well plates or tube arrays is provided which allows the securing of the lid to the plate or tube array, without changing the dimensions of the apparatus, so that current instrumentation for handling 96 well plates can still be utilized.

In addition, a multi-well plate or tube array is provided which has a plate defining a plurality of sample containment sites, each of the containment sites having an internal shoulder or annular rim; a gasket or O-ring disposed on the internal annular rim, and a lid having a projection that mates with and compresses the gasket or O-ring to seal the containment site.

The present invention also provides an apparatus that allows gas equilibration of the samples in the containment sites with the ambient atmosphere while preventing microbial, particulate, or chemical contamination of the samples from the atmosphere.

In yet another embodiment, the present invention provides a design whereby multiple sample containers can be sealed without the use of tight fitting caps or a gasket.

Finally, the present invention provides a glass slide that can be sealed without using any adhesives.

These and additional aspects of the present invention will be more fully described in the following detailed descriptions of the preferred embodiments.

DESCRIPTION OF THE DRAWINGS

FIG. 2 is an exploded perspective view of a multi-well titer plate assembly made in accordance with the present invention.

FIG. 2A is a perspective view of the apparatus described in detail with reference to FIG. 2.

FIG. 3 is a cross-sectional elevational view of a multi-well plate in one embodiment of the present invention.

FIG. 3A is an exploded perspective view of the invention described in detail with reference to FIG. 3.

FIG. 3B is a plan view of the gasket depicted in FIG. 3.

FIG. 3C is a plan view of a thermal equilibration membrane with annular rings of resilient gasket material fixed to it.

FIG. 4 is an exploded perspective view of a multi-well plate in another embodiment of the present invention.

FIG. 4A shows a fragmentary cross-sectional elevational view of the apparatus shown in FIG. 4, with a single well and corresponding portion of the lid broken away from the rest of the assembly.

FIG. 4B shows a fragmentary perspective view of the plate described with respect to FIG. 4, showing in detail the clipping mechanism.

FIG. 5 is a fragmentary cross-sectional elevational view of one sample containment chamber in a multi-container assembly having individual gaskets in accordance with one aspect of the present invention.

FIG. 5A is a fragmentary cross-sectional elevational view of one sample containment chamber made in accordance with another aspect of the invention shown in FIG. 5.

FIG. 5B is a plan view of an individual gasket for use in the apparatuses shown in FIGS. 5 and 5A.

FIG. 6 shows a cross-sectional elevational view of yet another embodiment of the present invention, with a single well broken away.

DETAILED DESCRIPTION OF THE PREFERRED EMBODIMENTS

Figure 1:
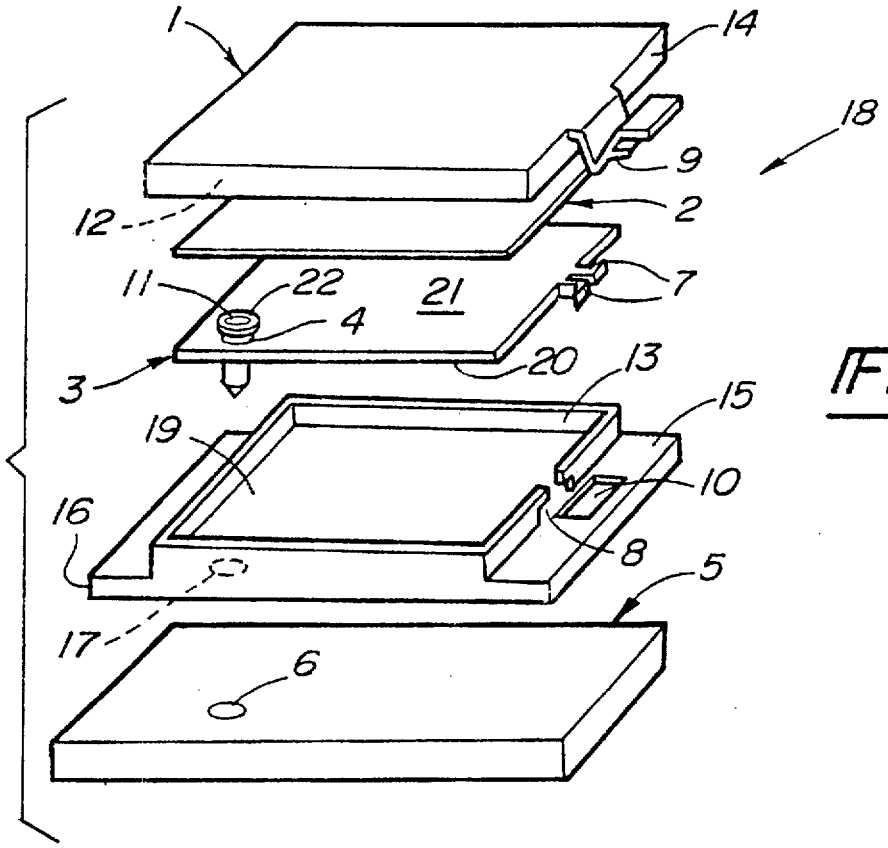
FIG. 1 is an exploded perspective view of a multi-tube tray assembly made in accordance with the present invention.
Figure 1A:
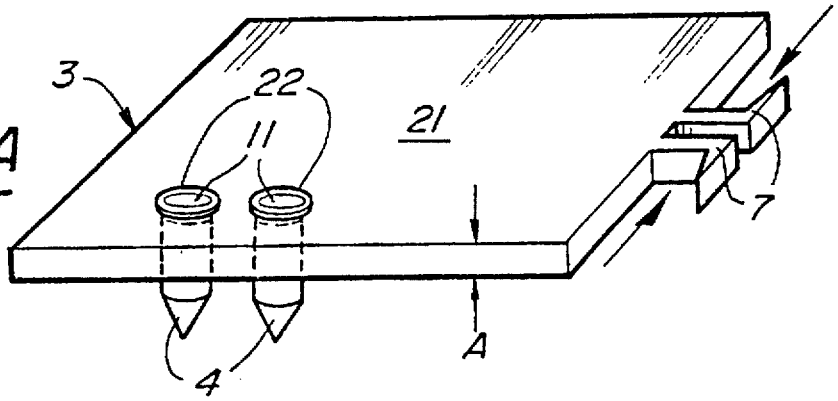
FIG. 1A shows a perspective view of the multi-tube plate of the assembly shown in FIG. 1.

Referring to FIG. 1 of the drawings, in one embodiment assembly 18 is shown with tube tray 3 having a plurality of tubes 4, only one of which is shown in FIG. 1 for the sake of clarity. Each tube 4 is provided with an opening or mouth 11. It will be appreciated that tray 3 may be formed as an integral or single-piece structure having tubes 4 or that tubes 4 may be formed as discrete units which are subsequently attached to tube tray 3 either temporarily or permanently. For example, tube tray 3 could comprise a plate with plurality of openings in which tubes 4 are held in the nature of a test-tube rack, with a holding or retaining plate being fixed reversibly and temporarily to the plate thereby holding the tubes in place. Tube tray 3 is preferably placed in tray carrier 16 having a principal surface 19 which mates with lower surface 20 of tube tray 3. Portions of tubes 4 which extend below lower surface 20 are received through holes 17 of tray carrier 16 into bores 6 of base plate 5. When tube tray 3 is inserted into tray carrier 16, protrusions or retaining arms 7 on tube tray 3 will engage tray carrier 16 at slot 8, thereby holding tube tray 3 in place. In this particular embodiment, slot 8 in side wall 13 is in the form of an inverted "T". When retaining arms 7 are first inserted into the vertical portion of slot 8, retaining arms 7 are pushed closer together by wall 13; when fully inserted into the final position, retaining arms 7 will be engaged at the wider portion of slot 8, returning to their normal positions by virtue of their flexibility, since side wall 13 will no longer be pressing them closer to each other. Thus, retaining arms 7 function as a snap-in fitting in this embodiment. In some embodiments it may be necessary to manually compress arms 7 together to slide them into position. Thus, tray 3 cannot be removed from carrier 16 without compressing arms 7 together in the direction shown by the arrows in FIG. 1A. It is to be appreciated that arms such as 7 can be built in more than one side of tube tray 3 and reciprocal slot 8 can be built in corresponding places of tray carrier 16 during manufacture. In FIGS. 1 and 1A, retaining arms 7 and slots 8 are shown on only one side of assembly 18 for the sake of simplicity. Other variations of arms 7 and slot 8 can be made in light of the teachings of the present invention.

Figure 1B:
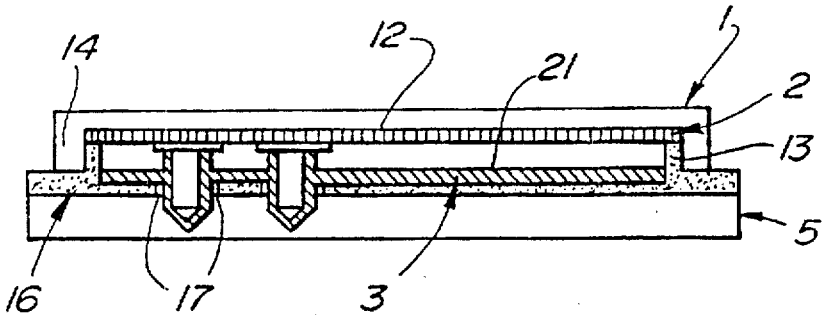
FIG. 1B shows a cross-sectional elevational view of the assembly described in detail with reference to FIG. 1.

Following the insertion of tube tray 3 in tray carrier 16 by fitting retaining arms 7 in slots 8, samples can be introduced into tubes 4. Sealing layer or resilient gasket 2, generally having the same geometry as principal surface 21 of tube tray carrier 16 is placed on top of tray 3 such that it covers the majority of principal surface 21, including most and preferably all of the individual openings 11. In general, gasket 2 comprises a resilient sheet or membrane which should be inert with respect to the samples within tubes 4. Gasket 2 may be formed of any deformable and resilient material and should not adhere or stick to principal surface 21 nor lid 1. In the preferred embodiment, the material from which gasket 2 is formed is substantially impermeable to liquids and gases. Examples of materials that could be used are silicon rubber, neoprene, and the like. Many foamed material, particularly closed-cell foams, are particularly resilient and are suitable. Gasket 2 may also include a coating of a highly inert, relatively inflexible material such as Teflon, which may be applied in a thickness which does not interfere with the resiliency of gasket 2. Resilient gasket 2 should have sufficient resiliency such that when it is compressed it forms a seal for the tops 22 of tube openings 11. The thickness of gasket 2 is not critical, but should be enough to form a seal when compressed by lid 1. Lid 1 is then placed on top of gasket 2, such that snap-in clip 9 is engaged by hole 10 in shoulder 15 of tray carrier 16. Through this engagement, pressure is applied to gasket 2 so that it seals openings 11 (most preferably hermetically) of tubes 4. In this embodiment, surface 12 of lid 1 is a simple planar surface i.e. a flat surface which applies a substantially equal force over the entire surface of gasket 2. In a different embodiment, annular collars protruding downwards from lower surface 12 of lid 1 are in alignment with tops 22 of tubes 4 thus exerting pressure on gasket 2 to insure sealing. In other applications, it may be desirable to bond gasket discs or annular rings to the lid, and numerous methods of attaching the preferred gasket materials to the lid will be known to those skilled in the art. Thus as shown in FIGS. 1 and 1B, lid 1 is in the nature of a "box-top" construction having walls 14 and inner lid surface 12. Lid 1 fits over walls 13 of tray carrier 16 as best shown in FIG. 1B. Gasket 2 is shown compressed by surface 12 onto the top of tubes 4. In still another embodiment, the thickness of tray 3 (dimensions A in FIG. 1A) is such that principal surface 21 is substantially flush or co-planar with the tops of walls 13 of tray 16. This latter configuration is particularly preferred where tray 3 is in the nature of a multi-well titer plate.

In one embodiment, which will be explained more fully in connection with FIGS. 3B and 3C, gasket 2 may be provided with an array of openings corresponding to the well or tube openings. Where gasket 2 has these openings, a sheet such as a mylar membrane may be disposed on top of resilient gasket 2. Thus, even after the lid is removed, the samples in the tubes remain covered with the mylar sheet, therefore reducing the chances of contamination of samples.

Referring to FIG. 1A, a significant portion of tubes 4 extend above the principal surface 21 of tray 3, with the top surfaces 22 of tubes 4 in a single plane parallel to principal surface 21. Thus, when tray 3 is placed in tray carrier 16 and gasket 2 is disposed on top with lid 1 clamped in place, top surfaces 22 of tubes 4 and the lower principal surface 12 of lid 1 compress gasket 2 between them, thereby sealing openings 11 of tubes 4. Upon completion of the reaction/processing/analysis, clip 9 can be opened and lid 1 removed. It is to appreciated that upon opening of clip 9 and leaving lid 1 in place, the pressure on gasket 2 is released. The resiliency of gasket 2 will therefore allow opening of the seal without the formation of aerosols which are formed upon opening of tight fitting snap-type caps. The gasket can also be non-compressible and still seal the wells. Such a gasket could be made of flexible but substantially non-compressible polyethylene, polypropylene and the like. Such a gasket could be also bonded to the lid, or the lid could be made of more than one material such that a gasket is not required.

Referring now to FIG. 2 of the drawings, in another embodiment of the present invention, assembly 39 has multi-well plate 23 provided with sample containment wells 24, each well 24 having a well opening 25 at principal surface 26. In the preferred embodiment, the tops 37 of wells 24 are coplanar, and are raised above principal surface 26 to facilitate sealing of wells 24 by gasket 30. It will be appreciated that multi-well plate 23 may comprise flat-bottom, U-bottom, conical bottom or semi-circular wells or the like. In this embodiment of the invention, plate 23 has a shoulder 27 which is wide enough to accommodate a clip or clamp assembly. It will be appreciated that in the embodiment where plate 23 is a conventional multi-well plate having an array of 96 wells, the length L and width W (shown in FIG. 2A) of plate 23 will be identical to the corresponding dimensions of conventional commercially available 96 well plates. Resilient gasket 30 is also provided which again covers principal surface 26 of plate 23 in close contact therewith such that it seals wells 24 by covering well openings 25 when lid 32 is snapped in place. Thermal equilibration membrane 31 is shown disposed on resilient gasket 30 to provide rapid thermal equilibration if necessary. Thermal equilibration membrane 31 will preferably be used in that embodiment of the invention which includes a gasket having an array of corresponding openings such as the gasket shown in FIG. 3B. It will be appreciated that holes 46 of the gasket 45 shown in FIG. 3B are in alignment with the well openings of principal surface 26. It should be understood that a thermal sheet of this type will not be necessary in many applications and will not be needed where the gasket does not have an array of openings. Lid 32 is again provided which serves to compress gasket 30 onto principal surface 26. Lid 32 is shown having a flat shoulder 33 which has a protruding ridge 34. When lid 32 is placed on plate 23 with gasket 30 in between, and pressure applied to the top of lid 32, ridge 34 will be engaged by the corresponding groove 35 in vertically protruding male member 36 on shoulder 27 of plate 23. Thus, it will be understood that these structures are somewhat flexible to allow the necessary bending for ridge 34 to be fitted into groove 35; that is to snap into place. Gasket 30 will thus be compressed between lid 32 and the tops 37 of well openings 25 thereby sealing wells 24 in the manner previously described. It will be appreciated that upon removal of lid 32, wells 24 will still be covered by gasket 30. The complete assembly with lid 32 in place on plate 23 is shown in FIG. 2A as assembly 38. On applying pressure to the male member 36 in the direction of the arrows as shown in the figure, groove 35 will disengage ridge 34 thereby resulting in opening of the seal. It will be appreciated that in this embodiment, male member 36 is shown as an integral part of plate 23. However, male member 36 could also be an independent piece inserted into plate 23 for holding lid 32 on plate 23 and sealing wells 24. Such variations of the clipping or clamping mechanism could also include a snap, hinge, sliding catch, or a hook, and will be apparent to those skilled in the art in light of the teachings of the present invention. In another embodiment (not shown), lid 32 has apertures corresponding to well openings 25 on plate 23 so that samples can be introduced into sample containment sites with a syringe or the like through a resilient and self-sealing gasket without removal of the lid. In the preferred embodiment, however, lid 32 does not have holes. FIG. 2A shows an external perspective view of the assembled invention described in detail with reference to FIG. 2. Being an external view, gasket 30 and membrane 31 are not visible.

Referring now to FIG. 3 of the drawings, a multi-well assembly 41 made in accordance with the present invention is shown in cross-sectional elevational view having multi-well plate 42 containing wells 43 at principal surface 44. Resilient gasket 45 having apertures 46 corresponding to well openings 47 is shown disposed on plate 42 in the manner previously described. Lid 48 compresses resilient gasket 45 onto principal surface 44 of plate 42 to form a seal at regions 49 which, as will be recognized, are those areas of principal surface 44 which surround each well 43. In order to secure lid 48 and gasket 45 in place on multi-well plate 42, clamp 50 is shown, which in this embodiment is a simple friction fit C-clamp or channel clamp. To hold the other side of the lid 48 in place on plate 42 such that pressure is applied uniformly to gasket 45, lip 51 is shown which slides into slots 52 in shoulder 53 of plate 42 in the nature of a tongue-in-groove catch. Thus, to position lid 48 in place on gasket 45 which in turn is disposed on plate 42, lid 48 is positioned at an angle to plate 42 so that lip 51 is engaged in slot 52 by shoulder 53 of plate 42. The opposite (with respect to the side of lip 51) side 54 of lid 48 is then lowered into place and clamp 50 is put in place in notch 55 of plate 42 thereby sealing the well openings. The catch and clamps may be of any convenient construction and may be attached to one or more sides of the assembly as required. Variations of this design will be apparent to those skilled in the art. It will be appreciated that in use lid 48 may be covered with contaminants such as dust, microorganisms or the like. In the present invention, the lid can be removed prior to removal of gasket 45 in a sterile or otherwise clean environment in those embodiments in which gasket 45 is bonded or otherwise interfaced within thermal equilibration membrane 31. That is, wells 43 will still be covered when lid 48 is removed by virtue of thermal sheet 31 overlying the corresponding openings in gasket 45. The use and aforementioned modifications of thermal membrane 31 and resilient gasket 45 are equally applicable to all embodiments of the present invention. Multi-well assembly 41 is shown in perspective view in FIG. 3A; note that gasket 5 and membrane 31 are not shown in FIG. 3A.

Referring now to FIG. 3B of the drawings, gasket 45 is shown having openings 46 in alignment with wells 43. In this embodiment, openings 46 have a diameter slightly smaller than the openings 47 of wells 43. This feature contributes to confinement of samples within wells 43 to prevent cross-contamination. It will be appreciated that by providing openings 46 in gasket 45, reagents and the like can be easily added to wells 43 simply by removing clamp 50 and lid 48 from the assembly 41 if membrane 31 is not used. The lid and clamps can then be replaced to close and seal wells 43. Alternatively, if the gasket has no openings, the lid can have apertures in alignment with the well openings so that reagents can be added by way of a syringe or the like, through the gasket, the gasket being made in that embodiment of a self-sealing material.

Referring now to FIG. 3C of the drawings, in an alternative embodiment, the sealing function of the resilient gasket is achieved by a modified thermal equilibration membrane or sheet 58. Thermal equilibration sheet 58 has annular rings 59 made of resilient material fixed or bonded onto it either by heat or adhesive bonding, ultrasonic welding, or any desired means, which would be well known to those skilled in the art. Thus, when sheet 58 is disposed between the lid and the base plate (having sample containment sites), annular rings 59 are compressed between the lower surface of the lid and the tops of the wells or tubes thereby sealing the wells. In this embodiment, internal diameter 60 is of slightly smaller diameter than the openings 47 of wells 43 as shown in FIG. 3 which contributes to confinement of samples within wells 43 to prevent cross-contamination.

Referring now to FIG. 4 of the drawings, another embodiment of the present invention is shown in exploded perspective view. Assembly 61 has a multi-well plate 62 having flat shoulder 63 and a plurality of wells 64. Lid 65 has a shoulder 66 with holes 67 in the shoulder. These holes are made such that when lid 65 is placed on plate 62, male projections or posts 68 are engaged by holes 67 in lid 65 and project through shoulder 66 of lid 65. Wells 64 have openings whose tops 69 are preferably raised above principal surface 70 of plate 62, making contact with the lower surface 71 of lid 65 when lid 65 is placed in proper alignment on plate 62. After placing lid 65 on plate 62, clip 72, shown here as a flat, flexible friction fit clip, is put in place such that lid 65 is held on plate 62, with downward pressure being exerted by lower surface 71 of lid 65 on raised rims 69 of wells 64. An effective seal would thus be formed by the mating of raised rims 69 and lower principal surface 71 of lid 65. Referring now to FIG. 4A, a single well 64 of assembly 61 with collar 73 protruding from lower principal surface 71 of lid 65 is shown. Annular collars 73 protruding down from lower surface 71 of lid 65 may be provided having an internal diameter 74 slightly greater than the outer diameter of wells 64 thereby sealing wells 64 more effectively and reducing the probability of cross-contamination of wells. It is to be appreciated that in this configuration a resilient gasket is not needed here for effective sealing. As an alternative to clips 72 as shown in the figure, standard crocodile clips (not shown) could also be used. It will be appreciated that the height, length and width of the assembly 61 may be identical to the corresponding dimensions of commercially available 96 well plates, so that current instrumentation can still be used; also, it would still be possible stack the assemblies on top of one another. Other embodiments of the present invention can also be stacked. This feature is also provided by the other techniques described herein for clamping of lids on the sample containing plates/tube arrays.

FIG. 4B shows a fragmentary perspective view of the clamping mechanism described in detail with respect to FIG.

4. In FIG. 4B, only projection 68 of plate 62 is shown; the rest of plate 62 is not depicted. Each vertical male projection 68 preferably has groove 76 which would engage clip 72 such that sufficient pressure is applied to efficiently seal all the sample containment sites. Alternative mechanisms of clips or clamping assemblies will be apparent to those skilled in the art in light of the disclosure of the present invention.

In another embodiment, and referring now to FIG. 5 of the drawings, gasket 77 is shown as a discrete flat annular element inserted into recess or annular bore or well 78 of plate 79. Plate 79 is shown as a single well or tube unit broken out from the plate or tray. Gasket 77 is disposed on shoulder 80 of well 78. Accordingly, lid 81 includes a projection 82 which fits into well 78 and mates with gasket 77 on shoulder 80 when lid 81 is placed on plate 79 in the proper orientation. When lid 81 is clamped in the proper orientation on plate 79, gasket 77 is compressed between surface 83 of projection 82 and the shoulder 80 of well 78, thereby sealing the well most preferably in a substantially hermetic manner. It is to be understood, that other than those embodiments of the present invention in which a gas permeable membrane is utilized, the seal of the containment sites which is achieved will typically be an hermetic seal. A similar arrangement is shown in FIG. 5A with two modifications.

Referring now to FIG. 5A, the apparatus shown is an alternative embodiment of that shown in FIG. 5. The resilient gasket comprises an O-ring 84 which may rest on shoulder 85 or which may be disposed in an annular channel 86 formed in shoulder 85, channel 86 being shown in phantom. In this embodiment, lid 87 has a projection or annular collar 88 with a central bore 89 such that only the surface 90 of collar 88 mates with O-ring 84 when lid 87 is placed on the plate in the proper orientation. Lid 81 of FIG. 5 and lid 87 of FIG. 5A are essentially interchangeable in FIG. 5 and FIG. 5A. Lid 87 may comprise a solid projection by simply filling in space 89 during the molding process. For the embodiments shown in FIG. 5 and FIG. 5A, the assembly may be clamped in any suitable manner. FIG. 5B shows a plan view of an individual gasket or O-ring used in the devices shown in FIG. 5 and FIG. 5A.

In still another embodiment, and referring now to FIG. 6 of the drawings, assembly 91 is shown in fragmentary cross-sectional elevational view, with one well of the plate broken away. It will be appreciated that one of the important uses of this assembly will be growth or processing of cell cultures, in which a high degree of stringency is needed to prevent microbial, particulate or chemical contamination while still allowing gas equilibration of the samples with a controlled atmosphere, an example of which is 5% carbon dioxide. Lid 92 is shown disposed on gas permeable membrane 93. Membrane 93 is shown disposed on resilient gasket 94 having holes 95 in alignment with well openings 96 of wells 97 in plate 98. Lid 92 in this embodiment is not a single impermeable layer with a flat principal surface as described above, but is formed such that it has collars 99 projecting down from lid 92 with holes 204 in collars 99. The lower surface 100 of collars 99 thus press down on membrane 93 when the apparatus is completely assembled. If so desired, another similar resilient gasket (not shown) could be placed between lid 92 and membrane 93. Also, membrane 93 could be placed on a porous grid (not shown) or a thick filter paper sheet to give mechanical support to membrane 93 with gasket 94 below the mechanical support. Lid 92 would then be clamped by any of the means previously described, lid 92 and plate 98 having been made accordingly. By clamping the assembly in the correct format as described, lower surfaces 100 of collars 99 would apply pressure to the tops 101 of wells 97 via gasket 94, with the membrane 93 disposed between lid 92 and gasket 94, thereby sealing the wells against particulate contamination and yet allowing gas equilibration of samples in wells 97 through membrane 93 via holes 204. The membrane material is not critical, examples being polycarbonate or polysulfone. It would be preferable to use a hydrophobic (such as Teflon or PVDF) membrane, as this would serve to prevent the flow-through of liquids through the membrane if the plate were overturned; this would also be a distinct advantage when hazardous materials are being processed. Thus, the preferred membrane is a gas permeable/liquid impermeable membrane. The pore size of the membrane is not critical; however, the pores should be small enough to keep out micro-organisms, dust, etc. while allowing free passage of gases. In a different embodiment, the membrane can be an impermeable sheet (mylar) with holes in alignment with the wells, with discs of gas-permeable membrane attached to the mylar sheet such that the holes in the mylar sheet are covered. Thus, the discs of gas-permeable membrane will be in alignment with the well openings when the apparatus is completely assembled in the proper manner. Variations of membrane material, pore size and type of clipping mechanisms will be apparent to those skilled in the art from the disclosure herein.

Figure 7:
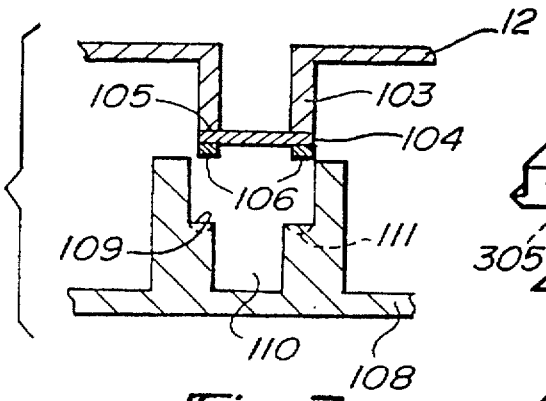
FIG. 7 shows a fragmentary cross-sectional elevational view of another configuration of the invention described in detail with respect to FIG. 6.

In another embodiment of the present invention, referring now to FIG. 7 of the drawings, a single well broken away from the plate is shown in fragmentary cross-sectional view. Lid 102 has annular collar 103 protruding from it with membrane 104 fixed with adhesive, solvent, heat or ultrasonic welding to the lower surface 105 of collar 103. Casket 106 in this embodiment could be a flat annular ring or an O-ring fixed to lower surface 105 of collar 103 with membrane disc 104 disposed in between. On clamping lid 102 in place on plate 108, gasket or O-ring 106 would mate with shoulder 109 built in well 110 of plate 108. In an alternative embodiment, gasket or O-ring 106 would be placed in an annular channel 111 built in shoulder 109 as shown in phantom, with annular collar 103 of lid 102 having only membrane 104 fixed to it. It is to be appreciated that the lids used for the inventions described with reference to FIGS. 6 and 7 would be very useful for tissue culture of cells. Moreover, once the processing of the cells in a controlled atmosphere is complete, the lids can be replaced with the lids described earlier, i.e., where the sealing is achieved with a gas impermeable seal; cells can thus be grown in the apparatus shown in FIGS. 6 and 7, the lid replaced as described above, and then frozen. Thus, the same plate can be used for tissue culture as well as for subsequent freezing or hermetic sealing of the cultures. Thus, this apparatus achieves a sort of hermetic sealing of the samples by virtue of excluding all non-gaseous matter from the wells while allowing gas exchange, and yet sealing in all the non-gaseous sample in the well.

Figure 7A:
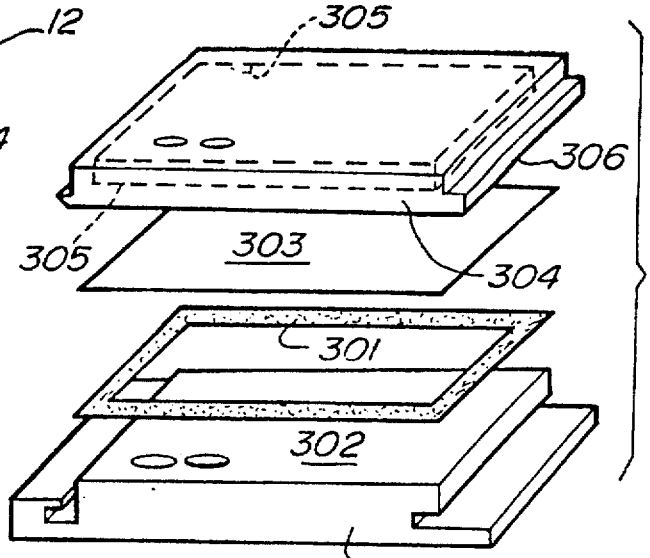
FIG. 7A is an exploded perspective view of the present invention in another aspect.

An alternative embodiment of the apparatuses shown in FIGS. 6 and 7 is shown in exploded perspective view in FIG. 7A. Plate 300 has a gasket 301 which lies on the principal surface 302 of plate 300, close to the edge of the plate. Membrane 303 lies on top of principal surface 302 with gasket 301 disposed in between. Lid 304 in this embodiment is similar to lid 92 of FIG. 6, but also has a wall 305 projecting down from the lower principal surface 306 along the edge of the lid. Wall 305 would be placed such than when assembled, the bottom of wall 306 would exert pressure on gasket 301 through membrane 303 thereby sealing the wells from external contamination, while still allowing gas equilibration of the samples in the wells. The membrane could also be fixed to the lower principal surface 306 of lid 304 and covered with a porous grid for mechanical support and for protecting the membrane from mechanical damage.

Figure 8:
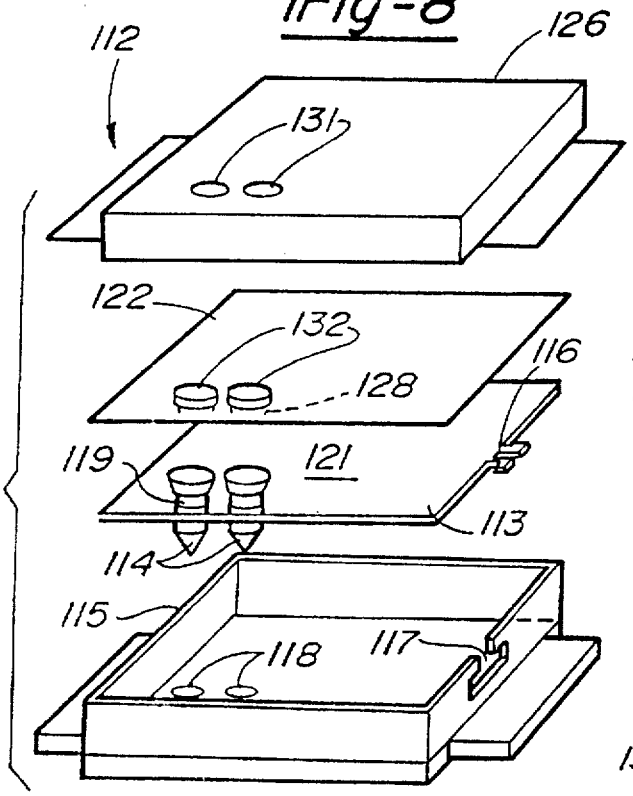
FIG. 8 shows an exploded perspective view of a multi-tube array made in accordance with the present invention, which can be sealed without the use of a gasket or tight-fitting caps.
Figure 8A:
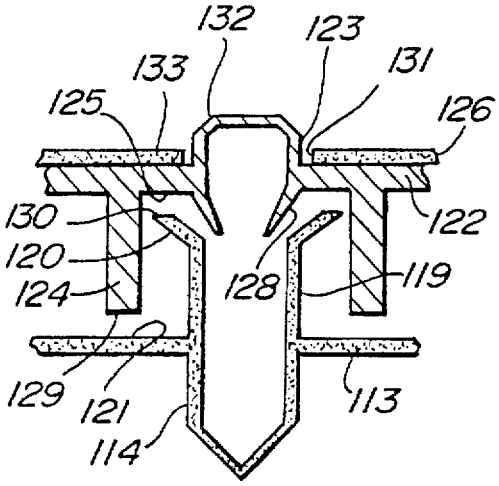
FIG. 8A shows a fragmentary cross-sectional view of the tube array and cap assembly described with respect to FIG. 8.

Yet another embodiment of the present invention is shown in FIGS. 8 and 8A, where assembly 112 consists of tube tray 113 having individual tubes 114. Tube tray 113 is held in place in tray holder 115 by means of male retaining arms 116 which mate with slots 117 in tray holder 115. When in place, the bottoms of tubes 114 will project through holes 118 in tray holder 115. An enlarged, fragmentary cross-sectional view of a single tube and well is given in FIG. 8A. Cap cover assembly 122 is clamped down by lid 126 such that caps 123 are in alignment with openings of tubes 114.

FIG. 8A shows an enlarged, cross-sectional fragmentary view of a single tube 114 sealed by a cap 123 broken away from the tray and cap assemblies. The top portions 119 of tubes 114 have flared necks 120 which rise significantly above the principal top surface 121 of tube tray 113. The cap assembly 122 has individual caps 123 and vertical walls 124 which project down vertically between caps 123 from the lower surface 125 of the cap assembly. Upon lid 126 being clamped in place by any of the means previously described, the walls 128 of caps 123 will mate with the flared necks 120 thereby sealing tubes 114 with a friction fit between the two. Also, lower surface 129 of vertical walls 124 will mate with the top surface 121 of tube tray 113. It will be obvious to those skilled in the art, that as a result of the angle of projection of the cap walls 128, sealing is achieved with very little pressure. The method of sealing here does not require tight fitting snap caps; thus, upon removal of a clamp (not shown) lid 126 and cap assembly 122 will rise a little bit because of the shape of walls 128 of caps 123, thus providing some degree of rebound, without the use of a rubber-like gasket material. However, even upon removal of the clamp, walls 128 of individual caps 123 will still remain in place mating with flared necks 120 of tubes 114, and the lower surface 129 of walls 124 will still extend significantly below the (top) principal surface 130 of the tops 119 of tubes 114. Thus, the chances of cross-contamination between individual tubes is eliminated without the use of a resilient gasket as provided in some of the previous embodiments. If so desired, the assembly 112 can be also designed such that when lid 126 is locked in place with the clamp, the top surface 130 of tube neck 120 will also mate with the (lower) principal surface 125 of lid 126, resulting in a third, additional, sealing area and mechanism. Lid 126 in this embodiment has holes 131 in the proper orientation such that when clamped in place on tray carrier 115, the tops 132 of individual caps 123 will project out above principal surface 133 of lid 126. This may be advantageous in situations where uniform heating or cooling of samples is required.

Figure 9:
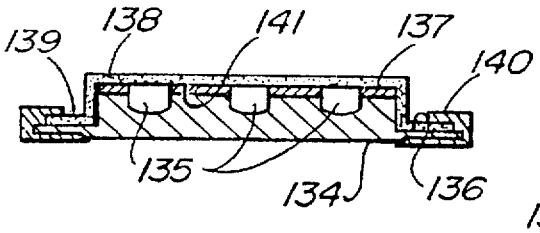
FIG. 9 shows a cross-sectional view of a microscope slide in yet another embodiment of the present invention.
Figure 9A:
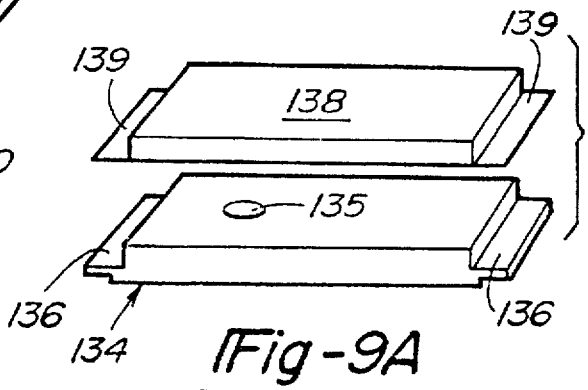
FIG. 9A shows an exploded perspective view of the invention described with respect to FIG. 9.

Finally, referring now to FIG. 9, another embodiment of the present invention is shown in cross-sectional view. Slide 134 is shown having a plurality of wells 135. Slide 134 also has shoulders 136 along the sides. Gasket 137 made of a resilient, rubber-like material as previously described, in the form of a sheet, is shown disposed around well 135 on slide 134. Cover 138 also has shoulders 139 corresponding to the positions of shoulders 136 of slide 134. C-clamp 140 holds cover 138 in place on slide 134, pressure being applied to gasket 137 by the lower surface 141 of cover 138, thereby sealing wells 135. The gasket and cover may have a non-symmetrical geometry such that it may be placed on the slide only in the correct orientation. Also, slide 134 need not have shoulders 136; in this embodiment, they are provided such that a majority of the lower principal surface of the slide is in contact with the support on which it rests, ensuring uniform heating if kept on a heating block. Shoulders 139 of cover 138 are provided for the same purpose, so that the contents of the wells may be uniformly heated from above. FIG. 9A shows a perspective view of the apparatus described in detail with reference to FIG. 9. In FIG. 9A, gasket 137 and clamp 140 are not shown. An alternative embodiment would provide gasket 143 in the form of an annular ring or O-ring, similar to the gasket in FIG. 5B. Gasket 143 would rest in an annular channel (not shown in FIG. 9 and FIG. 9A) formed around each well. The internal diameter of the gasket would be slightly smaller than the opening of the well, contributing to sample confinement. As in earlier embodiments, a thermal equilibrium membrane can also be used if desired. The gasket could also be in the form of a substantially continuous sheet without holes, as in some earlier embodiments. While the preferred embodiment has been described in detail with respect to FIGS. 9 and 9A, another variation could be as follows. The slide assembly could consist of a slide holder (comparable to the tray holder in FIG. 1), with the slide being in the form of a well-plate defining the depressions or sample wells (similar to the tube tray in FIG. 1). When the well-plate is in the proper orientation on top of the slide holder, the wells of the well-plate would protrude from holes in the slide holder (like the holes 17 in tray carrier 16 described in FIG. 1). The lid could then be clamped to the slide holder with the gasket in between the well-plate and the lid thereby sealing the wells.

Thus, it is apparent that there has been provided in accordance with the invention a method and apparatus that fully satisfies the objects, aims and advantages set forth above. While the invention has been described in connection with specific embodiments thereof, it is evident that many alternatives, modifications, and variations will be apparent to those skilled in the art in the light of the foregoing description. Also, it is apparent that any of the embodiments could be used with any other embodiment(s) depending on the requirements. Accordingly, it is intended to embrace all such alternatives, modifications and variations that fall within the spirit and broad scope of the appended claims.

What is claimed is:

1. A sealed multi-well plate having an array of wells depending from a planar principal plate surface, comprising:

a base plate defining a plurality of wells in an array, said base plate having a continuous planar principal surface, said wells extending below said continuous planar principal surface;

said base plate further defining an array of well openings at said continuous planar surface of said base plate corresponding with said wells;

a unitary lid plate having an uninterrupted planar surface, wherein said uninterrupted planar surface of said lid plate has an area sufficient to extend over the majority of said well openings;

a gasket disposed between said base plate and said lid plate and overlying said well openings;

said contact between said uninterrupted planar surface of said lid plate and said continuous planar principal surface of said base plate defining with said wells closed well chambers for containing a sample;

a closure snap fitting along the perimeter of and integral with said base plate and said lid plate, wherein said closure snap fitting releasably and securely holds said lid plate to said base plate and compresses said gasket to close said well chambers.

2. The apparatus recited in claim 1 wherein said closure snap fitting includes a flexible, integral snap fit portion on said lid and an engagement surface on said base plate, wherein said flexible, integral snap fit portion of said lid engages said engagement portion of said base plate.

3. The apparatus recited in claim 1, wherein said closure snap fitting includes a plurality of projections on said base plate, a plurality of holes defined by a flange extending from the edge of said lid plate in register with said plurality of base plate projections and further including a snap fit clip for engaging said projections to secure said lid plate to said base plate.

4. The apparatus recited in claim 1, wherein said base plate comprises a tube tray holder and a plurality of tubes held in said tube tray holder, said plurality of tubes defining said plurality of wells.

* * * * *